US007048159B1

(12) United States Patent
Bowers

(10) Patent No.: US 7,048,159 B1
(45) Date of Patent: May 23, 2006

(54) COLLAPSIBLE BOOTJACK

(76) Inventor: Judson L. Bowers, 401 S. Vista, Payson, AZ (US) 85541-4517

( * ) Notice: Subject to any disclaimer, the term of this patent is extended or adjusted under 35 U.S.C. 154(b) by 132 days.

(21) Appl. No.: 10/779,036

(22) Filed: Feb. 12, 2004

(51) Int. Cl.
*A47G 25/80* (2006.01)

(52) U.S. Cl. ..... 223/115

(58) Field of Classification Search ..... 223/114, 223/115, 116, 117
See application file for complete search history.

(56) References Cited

U.S. PATENT DOCUMENTS

| | | | | |
|---|---|---|---|---|
| 10,016 | A | 9/1853 | Sumner | |
| 13,002 | A * | 6/1855 | French | 223/116 |
| 171,398 | A * | 12/1875 | Massie | 223/116 |
| 174,433 | A | 3/1876 | Phenix | |
| 231,529 | A | 8/1880 | Boyington | |
| 3,652,009 | A | 3/1972 | Foster | |
| 3,734,364 | A | 5/1973 | Mayer | |
| 3,784,067 | A | 1/1974 | Hicks | |
| 3,786,970 | A | 1/1974 | Dixon | |
| 4,226,346 | A | 10/1980 | Turner | |
| 4,262,828 | A * | 4/1981 | Kosakai | 223/115 |
| 4,355,744 | A * | 10/1982 | Dudley | 223/114 |
| 4,394,946 | A * | 7/1983 | McCormick | 223/115 |
| 4,760,942 | A | 8/1988 | Kadar | |
| 5,133,488 | A | 7/1992 | Peterson | |
| D350,011 | S | 8/1994 | Edwards | |
| 5,516,015 | A | 5/1996 | Berzins et al. | |
| 5,806,729 | A | 9/1998 | Ramon | |
| D412,771 | S | 8/1999 | Kelley | |
| D420,203 | S | 2/2000 | Watkins | |
| 6,283,343 | B1 | 9/2001 | Hillmer | |

* cited by examiner

*Primary Examiner*—Danny Worrell
(74) *Attorney, Agent, or Firm*—Parsons & Goltry; Michael W. Goltry; Robert A. Parsons

(57) ABSTRACT

A bootjack for use in removing foot wear from the foot of a user includes a body which is pivotally linked to a body for movement between a stowage position and an operative position. In the stowage position, the body rests in juxtaposition upon the base. In the operative position, the rearward edge of the body bears against an abutment surface carried by the base and a linkage holds the forward yoke end of the body in an upwardly directed position for locationally receiving the lower posterior portion of the foot wear and engaging the upper edge of the heel to be removed. The bootjack is stabilized by the other foot or the user which presses downwardy upon the upper surface of the body.

17 Claims, 4 Drawing Sheets

FIGURE 10
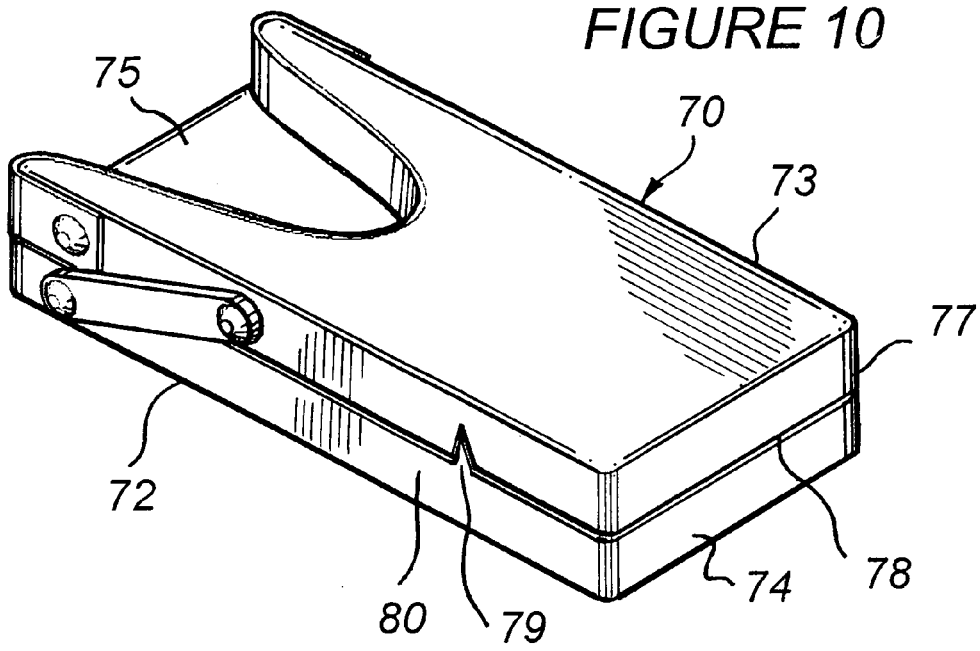
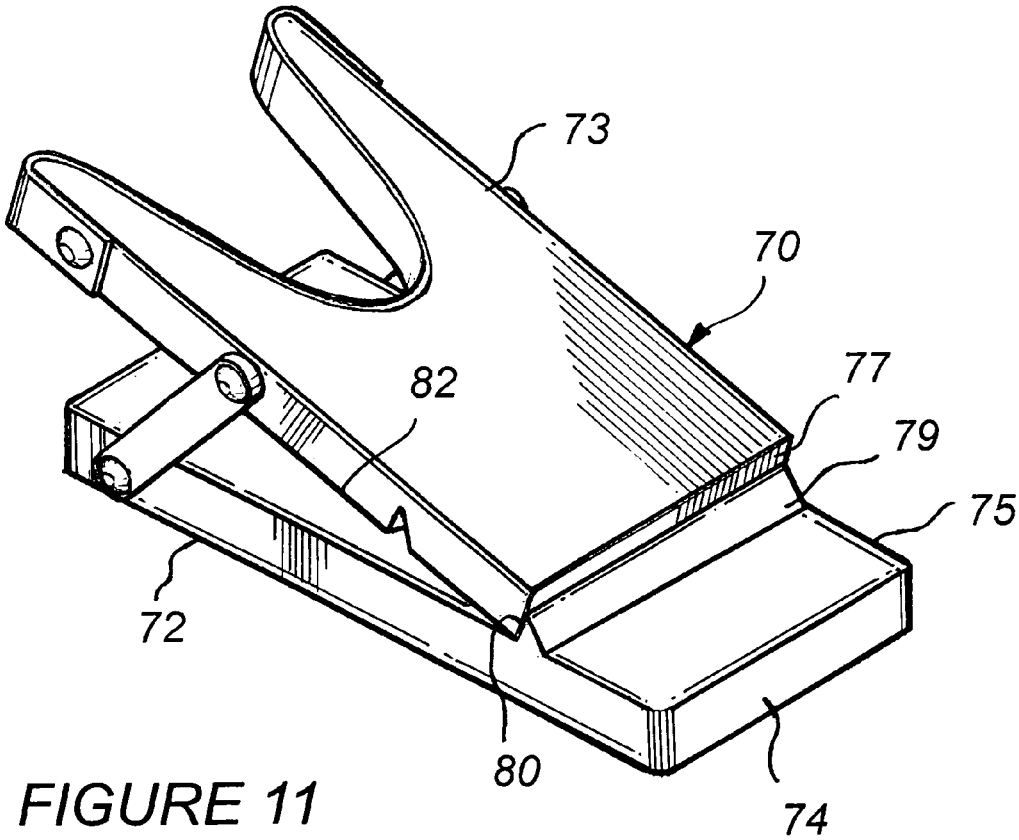
FIGURE 11

COLLAPSIBLE BOOTJACK

FIELD OF THE INVENTION

This invention relates to footwear accessories.

More particularly, the present invention relates to bootjacks for removing boots and other footwear from the foot of a wearer.

In a further and more specific aspect, the instant invention concerns a bootjack that is readily collapsible for compact stowage.

BACKGROUND OF THE INVENTION

Throughout the ages, boots have been common and popular footwear for males and for females. Cave painting in Spain, dated between 12,000 and 15,000 BC, show a man in boots of skin and a woman in boots of fur. Boots were found in the tomb of Khnumhotep, 2140–1785 BC, in Egypt. Today, boots are available in numerous variations for fashion, casual, sport and utility wear.

Modern boots are exemplified by the cowboy boot designed in Texas in the year 1878 and later popularized in cowboy movies. Typically, the boot includes an upper having a vamp for receiving the foot of the wearer and having a legging for receiving the lower leg or calf of the wearer. The vamp terminates at the forward end with a toe section for receiving the toes of the wearer and at the rear end with a heel section for receiving the heel of the wearer. Fixed to the underside of the vamp are a sole and a heel.

Generally, the vamp is relatively narrow and terminates with a pointed toe for a snug fit upon the foot. Additionally, the vamp is reinforced with a toe cap, a back stiffener or achilles tendon pad and an innersole upon which the foot rests. It is apparent, therefore, that the boot provides excellent support for the foot and lower leg of the wearer. It is equally apparent that substantial difficulty is encountered in removing the boot from the foot of the wearer.

In recognition of the arduous task of removing boots from the feet, the prior art has devised numerous removal devises commonly referred to as bootjacks. In general similarly, the prior art devices include a yoke for receiving the rear of the boot and an edge for engaging the heel. Otherwise, the structures vary substantially.

Many are outsized or rigid structures that require considerable storage space. Others require substantial manual manipulation in preparation for use. Still others are exceeding complex, having numerous components, and thereby being expensive to manufacture.

It would be highly advantageous, therefore, to remedy the foregoing and other deficiencies inherent in the prior art.

SUMMARY OF THE INVENTION

Accordingly, it is an object of the present invention to provide an improved bootjack for removing boots and other footwear from the foot of a wearer.

Another object of the invention is the provision of a bootjack that is quickly and easily movable between an operative configuration and a collapsed configuration.

And another object of this invention is to provide a bootjack that is readily collapsible into a relatively small, compact unit that can be conveniently carried in the pocket or travel bag.

Yet another object of the present invention is the provision of a collapsible bootjack that is wieldy and easily useable.

Still another object of the invention is to provide a bootjack structure that is simple and unencumbered.

A further object of this invention is the provision of a collapsible bootjack that is strong and durably constructed.

Yet still another object of the instant invention is to provide a bootjack having means to prevent scuffing or damage to the footwear being removed.

Yet a further object of the invention is the provision of a bootjack which will accommodate boots and footwear of varying sizes.

A still further object of this invention is to provide a bootjack that can be fabricated of various selected materials to satisfy the desires of the user.

A yet still further object of the invention is the provision of a collapsible bootjack having minimal operative components and therefore inexpensive to fabricate.

Briefly, to achieve the objects of the instant invention is accordance with a preferred embodiment thereof, first provided is a base having forward and rearward ends and an upper surface. Next provided is a body having forward and rearward ends and an under surface. A yoke for receiving and interacting with a boot or other footwear is formed into the forward end of the body. The body is connected to the base for movement between a stowage position in which the under surface of body is in juxtaposition with the upper surface of the base and an operative position is which the yoke projects angularly upward from the base. To prevent scuffing or marring the footwear to be removed, the surface of the yoke is lined with a resilient material.

An abutment is provided for the body in the operative position. In accordance with a preferred embodiment, the abutment includes a groove formed in the upper surface of the body, proximate the rear end thereof, for receiving the foot end of the body. In accordance with an alternate embodiment, the foot end of the body rests against an abutment in the form of a laterally extending ridge upstanding form the upper surface of the base.

A linkage assembly is provided for elevating the yoke end of the body. Preferably the linkage assembly includes a link having an end connected to the base and another end for supporting the yoke in the upwardly directed position. In accordance with a further embodiment, one end of the link is pivotally connected to a longitudinal edge of the base proximate the forward end thereof. Another end of the link is pivotally connected to a longitudinal edge of the body at an intermediate location thereof. In the collapsed configuration, the under surface of the body rests in juxtaposition with upper surface of the base.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings in which.

FIG. 10 is a perspective view of an alternate embodiment of the bootjack as it would appear in the collapsed or stowage position; and FIG. 11 is a perspective view of the embodiment of FIG. 10 as it would appear in the erected or operative configuration.

DETAILED DESCRIPTION OF THE PREFERRED EMBODIMENTS

Figure 1:
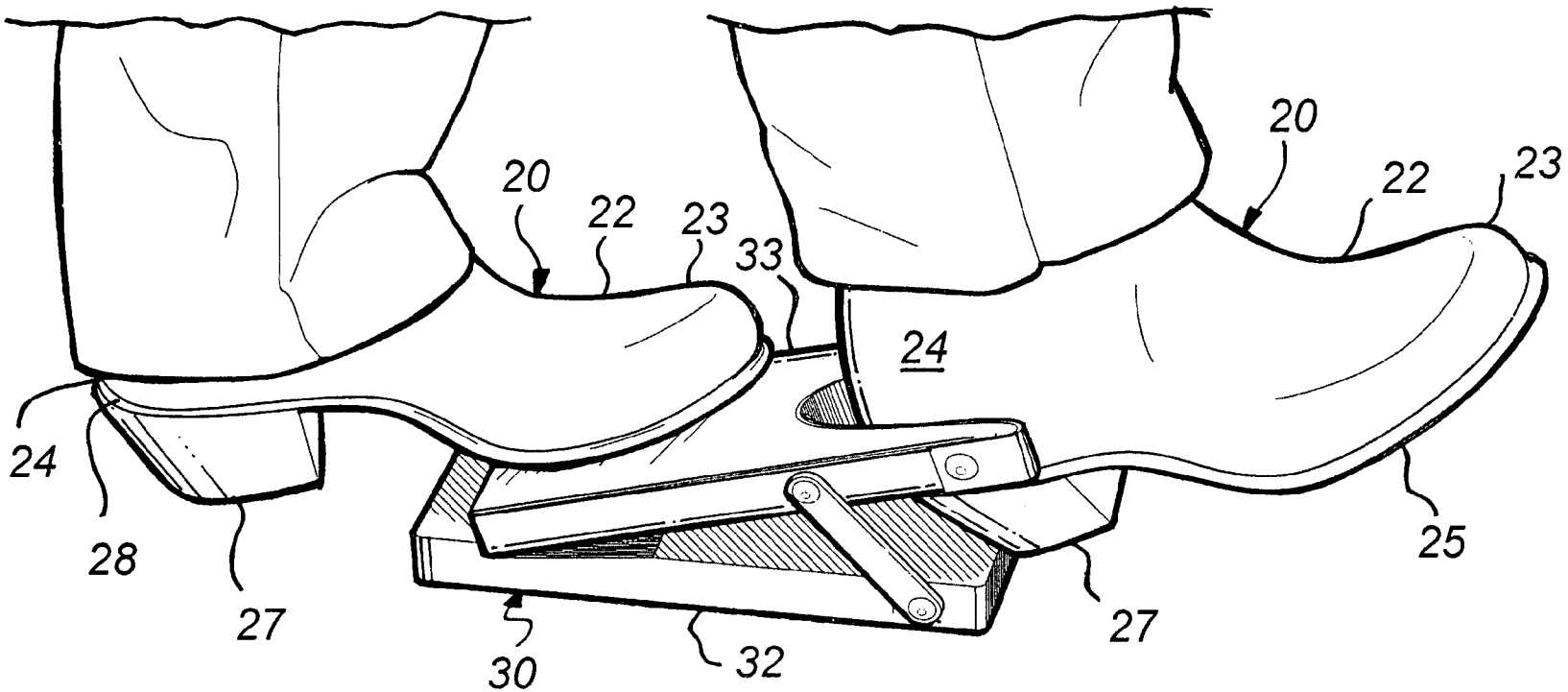
FIG. 1 is perspective view of a bootjack, constructed in accordance with the teachings of the instant invention, as it would appear in the operative position when in use for removing footwear.

Turning now to the drawings in which like reference characters designate corresponding elements throughout the several views, attention is first directed to FIG. 1 in which there is seen a boot, generally designated by the reference character 20, as it would appear when upon the foot of a wearer. Boot 20 includes vamp 22 having a forward terminal portion 23, common referred to as the toe, and a lower posterior portion 24, commonly referred to as the heel section. Boot 20 also includes sole 25 and heel 27. It is noted that sole 25 and heel 27 extend peripherally outward of heel section 25 therefore exposing an upper surface 28.

Other details of boot 20, not specifically illustrated nor described, will readily occur to those skilled in the art. For example, boot 20 includes an upper or legging extending upwardly from vamp 22. Also, while boot 20 has been shown and described as a cowboy boot, it will be appreciated that it is intended to be representative of boots and footwear in general.

Also seen in FIG. 1 is a bootjack, embodying the principles of the instant invention and generally designated by the reference character 30. Bootjack 30 includes base 32 and body 33 as will be described in detail as the description ensures.

Figure 2:
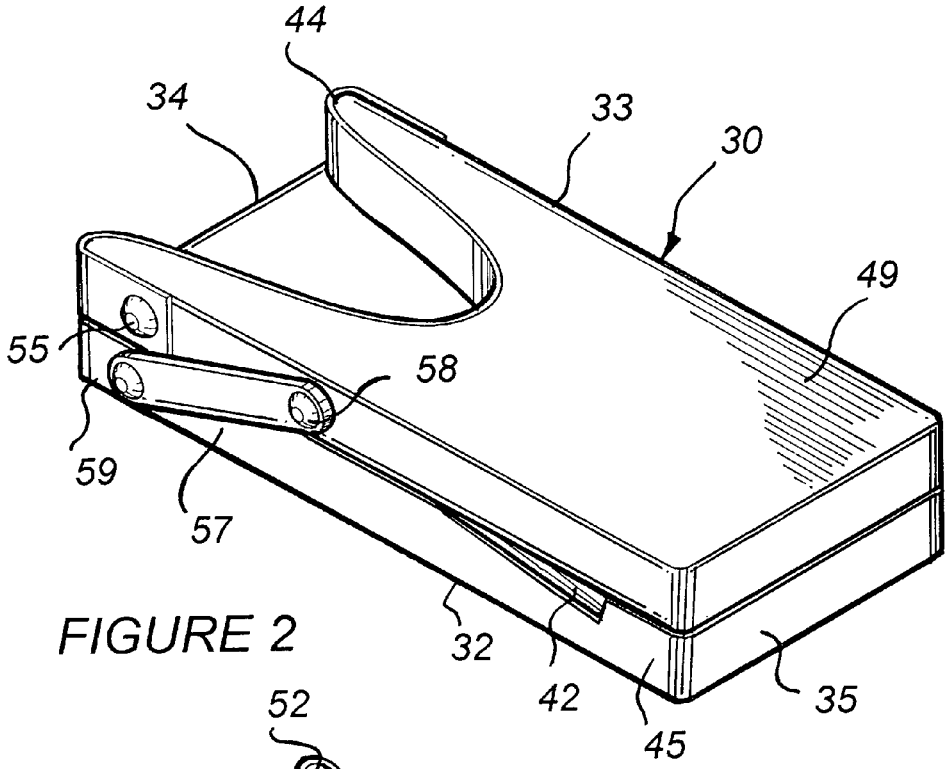
FIG. 2 is a perspective view of the bootjack of FIG. 1 as seen in the collapsed position.
Figure 3:
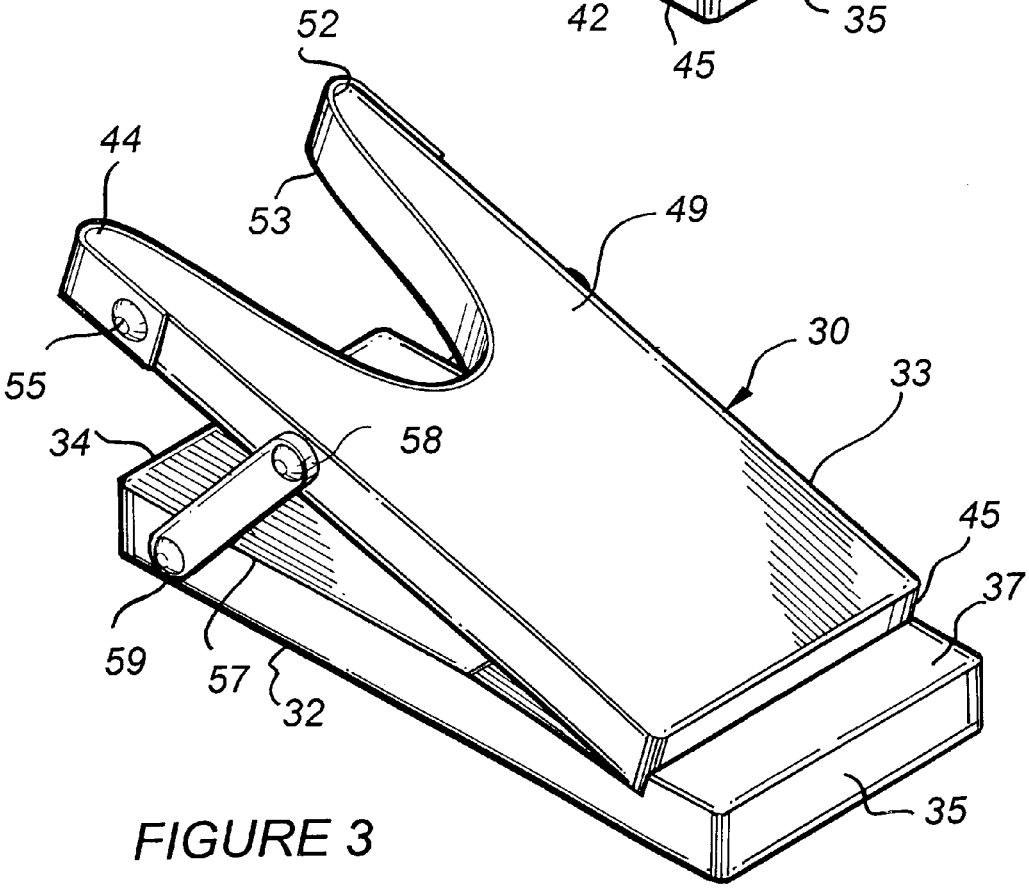
FIG. 3 is another perspective of the bootjack seen in the operative position.
Figure 9:
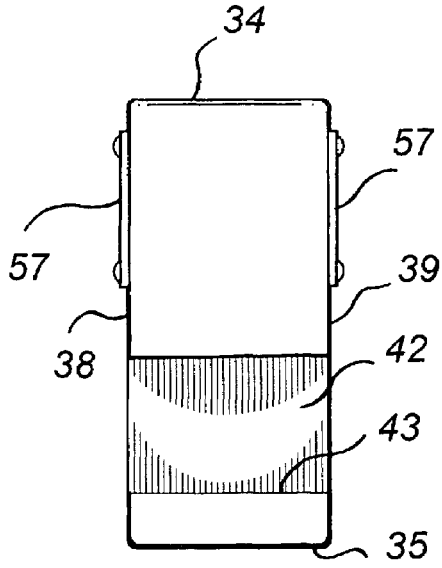
FIG. 9 is a top plan view of the base seen in FIG. 1.

Base 32, which is preferably rectangular as seen in FIGS. 2 and 3, includes forward end 34, rearward end 35 and upper surface 37. As seen with additional reference to FIGS. 4, 6 and 9, base 32 also includes first and second longitudinal 38 and 39, respectively, and under surface 40. Laterally extending groove 42 having abutment surface 43, as will be described in further detail presently, is formed into upper surface 37.

Figure 8:
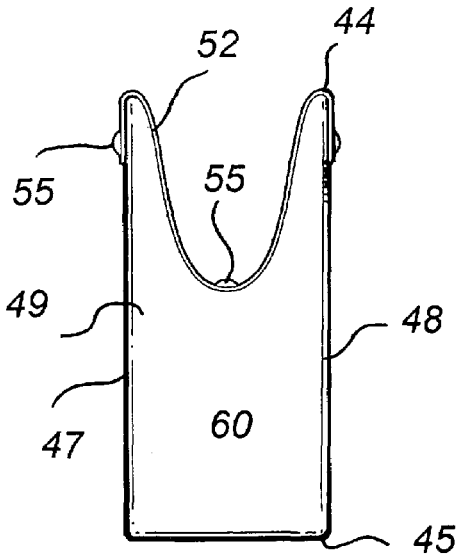
FIG. 8 is a top plan view of the operative body seen in FIG. 1.

Body 33, as seen with additional reference to FIG. 8, includes forward or yoke end 44, rearward end foot 45 and first and second longitudinal edges 47 and 48. Body 33 further includes upper surface 49 and under surface 50. A concave surface 52 having downwardly directed peripheral edge 53 is formed into forward edge 44. Lining 54, preferably a resilient material such as leather or synthetic material, overlays surface 52 and is secured thereto as by gluing or tacks 55.

Body 33 is movably attached to base 32 by means of a linkage assembly including link 57 having first end 58 and second end 59. First end 58 is pivotally connected to a longitudinal edge of body 33 by means of a mechanical fastener 60, such as a nail, screw or pin with a head. Second end 59 is similarly fastened to a longitudinal edge of base 32. First end 58 of link 57 is secured at an intermediate location along longitudinal edge 47 of body 33. Second end 59 of link 57 is secured to longitudinal edge 38 of base 32 proximate the forward end 34 thereof. As specifically illustrated in FIG. 9, mirror image links 57 are secured to either longitudinal edge of base 32 and corresponding longitudinal edges of body 33.

Figure 4:
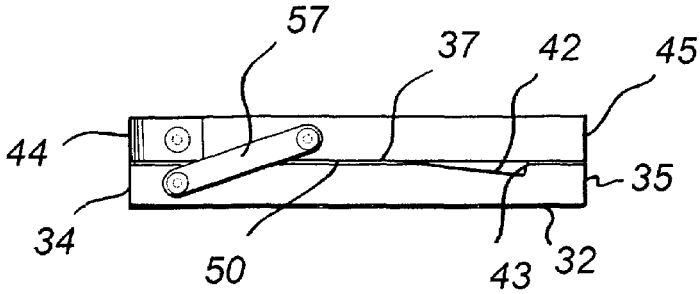
FIG. 4 is a side elevational view of the bootjack in the collapsed position.
Figure 5:
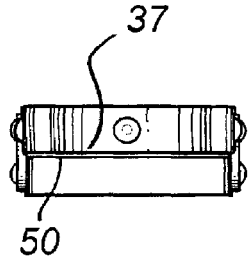
FIG. 5 is an forward end elevation view taken from the view of FIG. 4.
Figure 6:
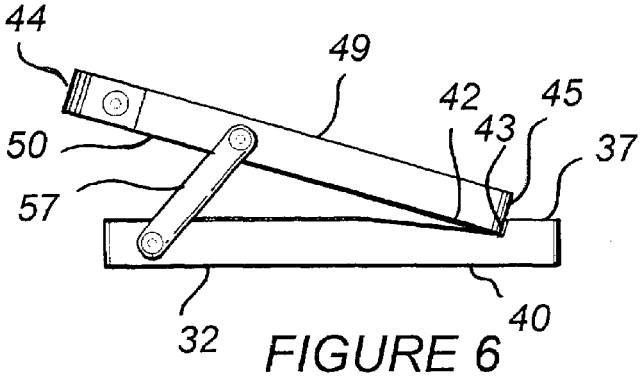
FIG. 6 is a side elevation view in the operative position.
Figure 7:
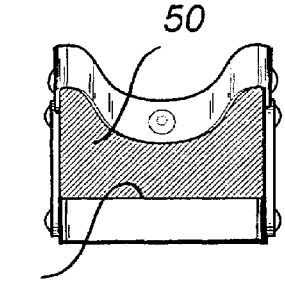
FIG. 7 is a forward end elevation view taken from the view of FIG. 6.

Body 33 is movable relative base 32 between a compact stowage position, as illustrated in FIGS. 2, 4 and 5, and an operative position, as viewed in FIGS. 3, 6 and 7. In the stowage position, under surface 50 of body 33 rests in juxtaposition with upper surface 37 of base 32. In the operative position, the under surface 50 of body 33 is angularly disposed to the upper surface 37 of base 32. Links 57 support the forward or yoke end 44 of body 33 in an upwardly directed position. Rearward end or foot 45 of body 33 rests within groove 42 bearing against abutment surface 43.

As clearly illustrated in FIG. 1, concave surface 52, with body 33 in the operative position, functions as a yoke, extending upwardly and away from the user, to receive and positionally locate the lower posterior portion or heel section 24 of boot 20 whereby peripheral edge 52 of body 33 engages the upper surface 28 of heel 27. Surface 60 proximate the rearward end 45 of body 33 functions as a pedal for receiving another foot of said wearer thereagainst to hold and stabilize the bootjack as the foot is pulled from boot 20.

Reference is now made to FIGS. 10 and 11, in which is seen an alternate embodiment of a boot jack, constructed in accordance with the present invention and generally designated by the reference character 70, including base 72 and yoke body 73. In general similarity to the previously described embodiment 30, base 72 includes rearward end 74 and upper surface 75. Body 73 includes rearward end 77 and under surface 78.

Previously described links 57 pivotally interact between base 72 and body 73. In all aspects otherwise described, bootjack 70 is structurally and functionally equivalent to the previously described bootjack 30.

In difference to the previously described embodiment, a ridge 79 having abutment surface 80 extends laterally across the upper surface 75 of base 72 proximate the rearward end 74 thereof. Laterally extending recess 82 formed into undersurface 78 of body 72 receives ridge 79 when the bootjack is in the compact stowage position. In the operative position, rearward edge 77 of body 73 bears against abutment surface 80 of ridge 79.

The present invention is described above with reference to preferred embodiments. Those skilled in the art will recognize that changes and modifications may be made in the described embodiments without departing from the nature and scope of the present invention. Various modifications and variations to the embodiments herein chosen for illustration will readily occur to those skilled in the art. To the extent that such modifications and variations do not depart spirit of the invention, they are intended to be included with the scope thereof.

Having full described and disclosed the present invention and preferred embodiments thereof in such clear and concise terms as to enable those skilled in the art to understand and practice the same, the invention claimed is:

The invention claimed is:

1. A collapsible bootjack for removing footwear from the foot of a wearer, which footwear includes a lower posterior portion and a heel depending therefrom, and for compact stowage, said bootjack comprising:

a base having opposed forward and rearward ends and an upper surface;

a body having opposed forward and rearward ends and an under surface;

a yoke formed in the forward end of said body for receiving and interacting with said footwear; and said body being connected to said base for selective movement between a stowage position in which the under surface of said body resides in substantial juxtaposition with the upper surface of said base and an operative position in which said yoke projects angularly upward relative said base; and retention means for retaining said body in the operative position comprising a laterally extending groove formed in the upper surface of said base and having an abutment surface for receiving the rearward end of said body thereagainst.

2. The bootjack of claim 1, in which said yoke includes a concave surface for receiving and locationally positioning the lower posterior portion of said footwear.

3. The bootjack of claim 2, wherein said yoke further includes a downwardly directed peripheral ridge for engaging the heel of said footwear.

4. The bootjack of claim 2, further including a resilient lining overlaying said concave surface.

5. The bootjack of claim 1, further including a linkage assembly interacting between said base and said body for retaining said body in the operative position.

6. The bootjack of claim 5, wherein said base includes a longitudinal edge and said body includes a longitudinal edge and said linkage assembly includes:

an elongate link having a first end pivotally connected to the longitudinal edge of said base and a second end pivotally connected to said body.

7. The bootjack of claim 6, wherein the first end of said link is connected to said base proximate the forward end thereof and the second end of said link is connected to said body at an intermediate location.

8. The bootjack of claim 1, further including an upper surface carried by said body proximate the rearward end thereof for receiving another foot of said wearer.

9. A collapsible bootjack for removing footwear from the foot of a wearer, which footwear includes a lower posterior portion and a heel depending therefrom, and for compact stowage, said bootjack comprising:

a base having opposed forward and rearward ends and an upper surface;

a body having opposed forward and rearward ends and an under surface;

a yoke formed in the forward end of said body for receiving and interacting with said footwear; and said body being connected to said base for selective movement between a stowage position in which the under surface of said body resides in substantial juxtaposition with the upper surface of said base and an operative position in which said yoke projects angularly upward relative said base; and retention means for retaining said body in the operative position comprising a laterally extending ridge upstanding from the upper surface of said base and having an abutment surface for receiving the rearward end of said body thereagainst.

10. The bootjack of claim 9, further including a recess formed in the under surface of said body for receiving said ridge therein when said body is in the stowage position.

11. The bootjack of claim 9, in which said yoke includes a concave surface for receiving and locationally positioning the lower posterior portion of said footwear.

12. The bootjack of claim 11, wherein said yoke further includes a downwardly directed peripheral ridge for engaging the heel of said footwear.

13. The bootjack of claim 11, further including a resilient lining overlaying said concave surface.

14. The bootjack of claim 9, further including a linkage assembly interacting between said base and said body for retaining said body in the operative position.

15. The bootjack of claim 14, wherein said base includes a longitudinal edge and said body includes a longitudinal edge and said linkage assembly includes:

an elongate link having a first end pivotally connected to the longitudinal edge of said base and a second end pivotally connected to said body.

16. The bootjack of claim 15, wherein the first end of said link is connected to said base proximate the forward end thereof and the second end of said link is connected to said body at an intermediate location.

17. The bootjack of claim 9, further including an upper surface carried by said body proximate the rearward end thereof for receiving another foot of said wearer.

* * * * *